United States Patent [19]

Okano et al.

[11] 4,384,794

[45] May 24, 1983

[54] PRINTER

[75] Inventors: Noriaki Okano; Susumu Matsuda, both of Shizuoka; Keisuke Murakami, Shuzenjimachi, all of Japan

[73] Assignee: Tokyo Electric Co., Ltd., Tokyo, Japan

[21] Appl. No.: 250,079

[22] Filed: Apr. 1, 1981

[51] Int. Cl.[3] ..... B41J 11/20

[52] U.S. Cl. ..... 400/56; 400/636; 400/59

[58] Field of Search ..... 400/54, 55–59, 400/636, 663, 664, 356, 668, 120, 639.1, 639; 101/231–235

[56] References Cited

U.S. PATENT DOCUMENTS

| | | | |
|---|---|---|---|
| 356,406 | 1/1887 | Hey et al. | 101/234 |
| 3,519,117 | 7/1970 | Smith | 400/639.1 |
| 3,935,936 | 2/1976 | Wilczewski | 400/54 |
| 3,988,984 | 11/1976 | Lindelöv et al. | 101/93.15 |
| 4,024,940 | 5/1977 | Hendrischk et al. | 400/59 |
| 4,049,109 | 9/1977 | Plaza et al. | 400/356 |
| 4,086,997 | 5/1978 | Wu | 400/59 |
| 4,134,695 | 1/1979 | Randolph | 400/356 |
| 4,160,606 | 7/1979 | Caenazzo | 400/616.2 |
| 4,189,244 | 2/1980 | Harrison | 400/59 |
| 4,268,177 | 5/1981 | Veale | 400/59 |

FOREIGN PATENT DOCUMENTS

| | | | |
|---|---|---|---|
| 2248262 | 4/1974 | Fed. Rep. of Germany | 400/56 |
| 2844150 | 4/1979 | Fed. Rep. of Germany | 400/58 |
| 2407820 | 7/1979 | France | 400/56 |
| 55-111281 | 8/1980 | Japan | 400/59 |

*Primary Examiner*—William Pieprz

*Attorney, Agent, or Firm*—Oblon, Fisher, Spivak, McClelland & Maier

[57] ABSTRACT

The present invention provides a printer in which a printing head confronting a platen and a paper pressing roller for pressing a recording paper are attached to the same levers mounted rotatably and turnably and the distance between the top end of the printing head and the platen can directly be changed according to the thickness of the recording paper to be inserted, whereby influences of changes of the paper thickness on the printing state can be eliminated substantially. In this printer, the distance between the top end of the printing head and the platen can be adjusted very precisely by a simple structure.

8 Claims, 4 Drawing Figures

1
2
3
5
6
7
8
10
11
12
14
15
16
17
18
19
22
24
26
27
30
31
32
33
35
36
37

PRINTER

DESCRIPTION OF THE INVENTION

The present invention relates to a printer. More particularly, the present invention relates to a printer of the type in which the quality of printed letters is significantly influenced by a slight change of the space between the top end of a printing head and the surface of a recording paper, such as a dot printer.

In the conventional printer of the type in which a printing head is reciprocatively shifted along a platen, the paper thickness is changed when the number of recording papers is increased or decreased or when a chit or the like is selectively inserted in ordinary recording papers and printing is carried out in this state. In this case, it is desired that the quality of printed letters should be made uniform by changing and adjusting the relative position of the printing head to the platen. This can be achieved by detecting the paper thickness and determining the position of the printing head according to the detected thickness. Various means have been proposed and adopted for attaining this purpose. For example, U.S. Pat. No. 3,988,984 discloses a printer provided with such means. The printer disclosed in this U.S. Patent is not different from the conventional printer in that a printing head is disposed reciprocatively movably on the front face of a cyclindrical platen horizontally located, but in this printer, a detecting roller engaging with recording papers wound around the platen is attached to a lever in the lower portion of the platen. This lever is connected to a lever on the side of the printing head through a rotary shaft or other connecting lever, so that the position of the printing head is determined by the movement of this lever. In short, in this printer, since the paper thickness-detecting portion is much spaced from the position of the printing head and the operation directions of these two members are opposite to each other, a complicated lever mechanism must inevitably be interposed. Therefore, the number of connecting and coupling members is very large and the structure is complicated, and hence, it is very difficult to precisely grasp the relation between the value of the change of the paper thickness and the quantity of the movement of the printing head. Accordingly, in order to attain the intended object effectively, it is necessary to manufacture respective parts with very high precision. Furthermore, adjustment at the assembling step is very difficult, and it is very difficult to maintain certain capacities in the printer.

It is a primary object of the present invention to provide a printer in which the position of a printing head can precisely be determined according to the thickness of recording papers.

Another object of the present invention is to provide a printer in which a paper pressing roller is used as means for detecting the thickness of recording papers and this paper pressing roller and a printing head are disposed on the same levers, whereby the structure is simplified and adjustment of the position can be accomplished very precisely.

Still another object of the present invention is to provide a printer in which on insertion of a chit or the like, the insertion position can assuredly be maintained in the open state and on feeding of papers, the paper pressing state can assuredly be restored.

A further object of the present invention is to provide a printer in which an arrangement is made so that no printing driving signal is emitted unless the paper pressing state is maintained, whereby an erroneous operation is prevented.

The present invention will now be described in detail with reference to the accompanying drawings, in which.

Figure 1:
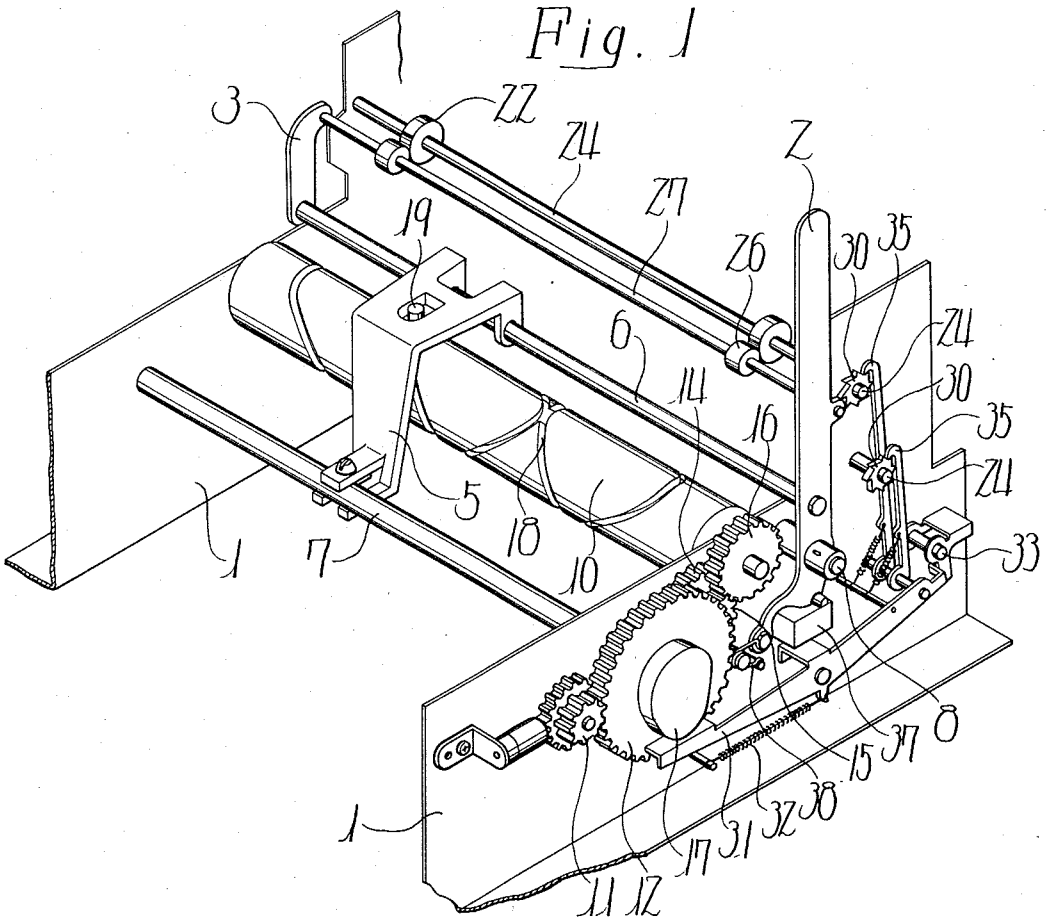
FIG. 1 is a perspective view showing one embodiment of the printer of the present invention in the state where a printing head is taken out.

One embodiment illustrated in the accompanying drawings will now be described. A pair of confronting frames 1 are disposed on the left and right sides, respectively, and levers 2 and 3 are held on the outer surfaces of the frames 1 so that the levers can turn along the frames 1 with shafts 8 being the centers. Both the end of a guide shaft 6 slidably supporting a carrier 5 having a printing head 4 for a dot printer stationarily assembled thereon are supported on the levers 2 and 3. Both the ends of another guide shaft 7 are supported on the frames 1 in the state where the shaft 7 is gripped by the rear portion of the carrier 5.

Figure 2:
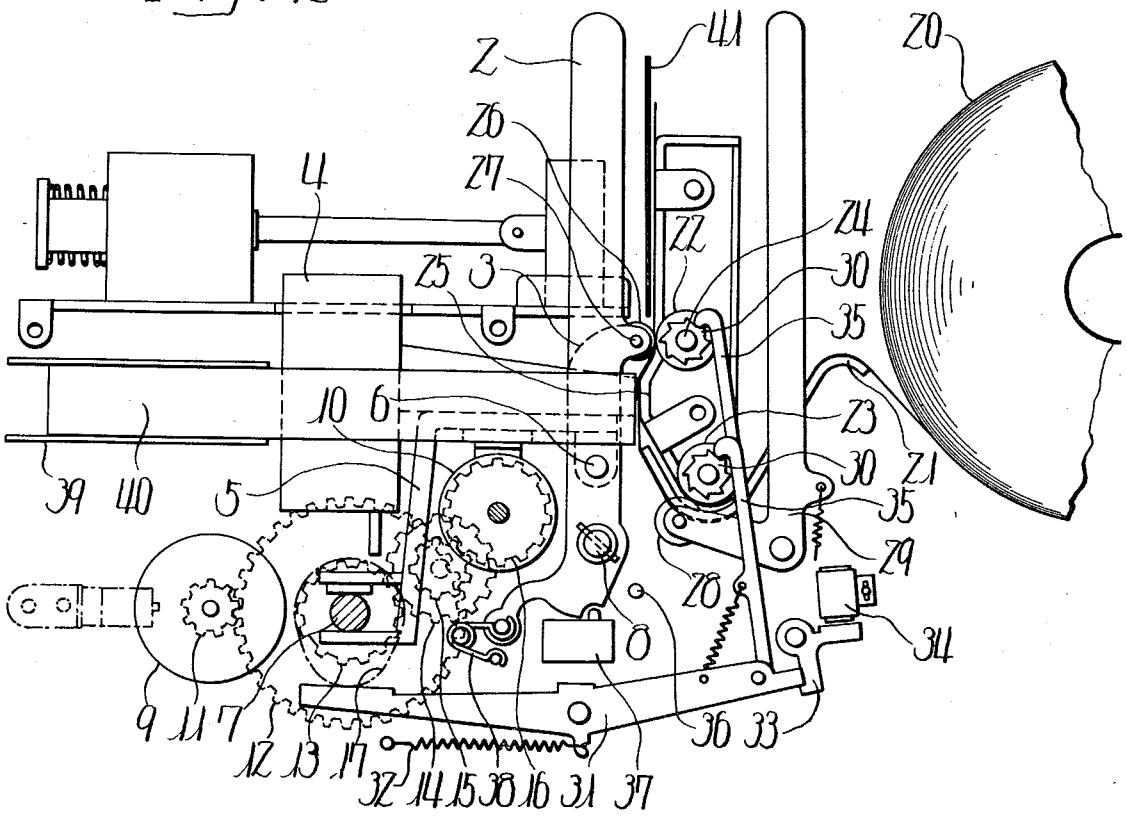
FIG. 2 is an enlarged view of the printer in the state where a frame is dismounted.
Figure 3:
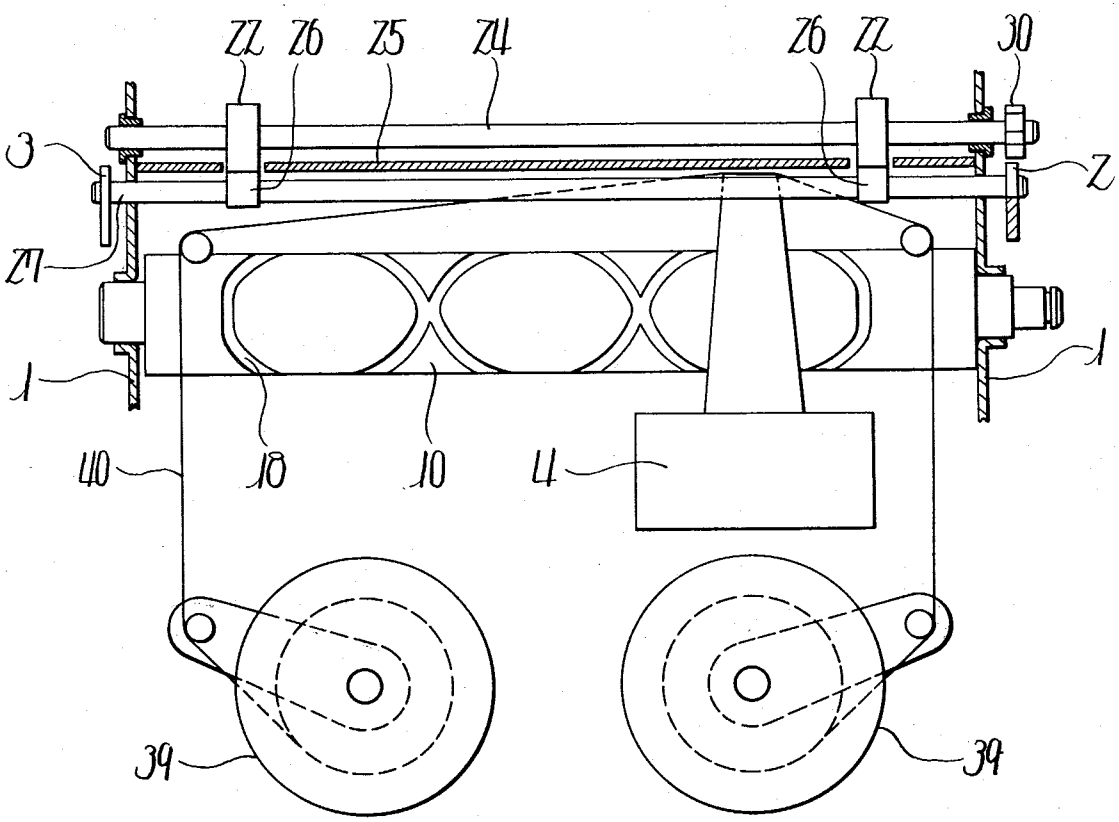
FIG. 3 is a top plan view showing a part of the printer shown in FIG. 2.
Figure 4:
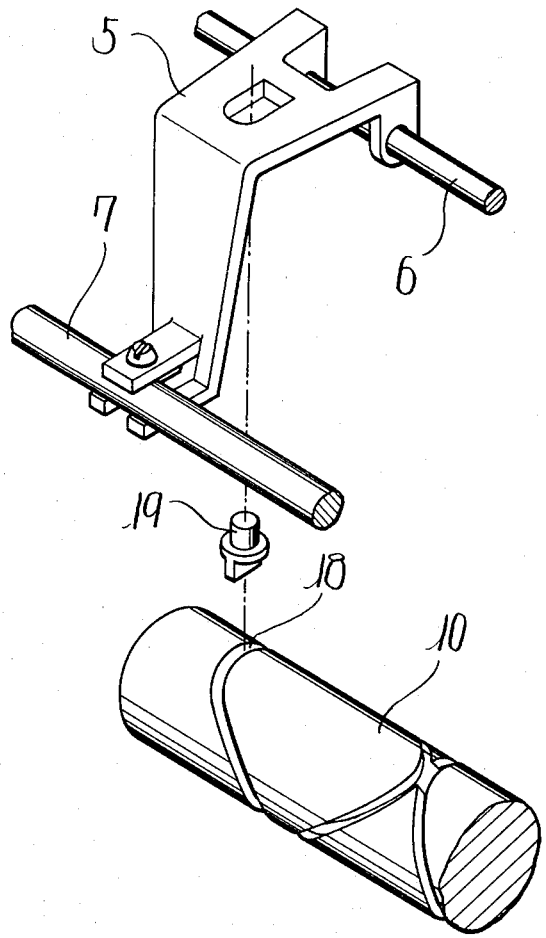
FIG. 4 is a fragmentary perspective view illustrating a part of a mechanism for driving a carrier.

FIG. 2 is a side view in which the frames 1 are omitted to show arrangement of parts. A motor 9 is secured to one frame 1 and gears 11, 12, 13, 14, 15 and 16 are positioned to reduce the rotation speed of the motor 9 and transmit the reduced rotation speed to a cam 10. A paper feed cam 17 is disposed so that the cam 17 rotates coaxially with the gear 12. The cam 10 has a drum-like shape, and on the periphery of the cam 10, there is formed an endless spiral groove 18 starting from one end, extending to the other end and returning to said one end. A cam follower 19 to be engaged with this groove 18 is supported on the carrier 5 and is rotatably mounted around the vertical axis.

A guide plate 21 is disposed between said frames 1 to guide a long recording paper 20 to a platen 25, and shafts 24 having paper feed rollers 22 and 23 fixed thereon are rotatably supported between the frames 1. A paper pressing roller 26 confronting the upper paper feed roller 22 is fitted in and held on a shaft 27 having both the ends supported on the levers 2 and 3. A pinch roller 28 as a pressing member confronting the lower paper feed roller 23 is supported by another lever 29. Ratchets 30 are fixed to one ends of the shafts 24 of the paper feed rollers 22 and 23, respectively.

A seesaw lever 31 having one end confronting the paper feed cam 17 is attached to one frame 1 while the seesaw lever 31 is rotatably urged by a return spring 32. A stop lever 33 and a magnet 34 are held on one frame 1 so that the other end of the seesaw lever 31 is locked. Feed levers 35 to be engaged with the above-mentioned ratchets 30 are connected to the seesaw lever 31.

A stopper 36 for regulating the range of the turning movement of the lever 2, a switch 37 as detecting means, which is put off by movement of the lever 2 in the counterclockwise direction to open a printing driving circuit, and a toggle spring 38 for urging the lever 2 in the clockwise direction or counterclockwise direction every time the lever 2 turns from one side to the other side with the neutral position being as the center are attached to the frame 1.

A printing ribbon 40 having both the ends held by spools 39 is pulled out and located on the front face of the platen 25.

In the printer having the above-mentioned structure, the rotation of the motor 9 is transmitted to the cam 10 through the gears 11 through 16, and the carrier 5 having the cam follower 19 engaged with the groove 18 of the rotating cam 10 makes a reciprocative movement along the guide shafts 6 and 7 while the carrier 5 holds the printing head 4 thereon. During this process, the printing operation is performed. As the other cam 17 is being rotated, the seesaw lever 31 is pressed by a high part of the cam 17 and turned in the counterclockwise direction, and at this point, the magnet 34 is energized to attract the stop lever 23 in the counterclockwise direction. Accordingly, at the point when the high part of the cam 17 passes away, the seesaw lever 31 is turned in the clockwise direction by the force of the spring 32 to bring down the feed lever 35 and intermittently turn the ratchet 30, and the paper feed rollers 22 and 23 feed the recording paper 20 by one pitch.

When the printing operation is performed on a chit 41, the levers 2 and 3 are brought down in the counterclockwise direction. In this state, the levers 2 and 3 are urged in the bring-down direction by the toggle spring 38 but their positions are determined by the stopper 36. Accordingly, the guide shaft 6 is allowed to shift along a locus with the shaft 8 being as the center, and the printing head 4, together with the carrier 5, is separated from the platen 5. At this point, the rear portion of the carrier 5 slides in a direction perpendicular to the other guide shaft 7, and therefore, the retreating movement of the carrier from the platen 25 is not inhibited by the guide shaft 7. Furthermore, by virtue of an arrangement in which on both the ends of the cam 10, the groove 18 is extended in a direction perpendicular to the axis of the cam 10, only the movement of the carrier 5 and printing head 4 in a direction separating from (or approaching to) the platen 25 is allowed while the movement of the carrier 5 and printing head 4 along the platen 25 is inhibited. Accordingly, the chit 41 can easily be inserted on the front face of the platen 25. Then, the levers 2 and 3 are returned in the clockwise direction and the paper press roller 26 is brought into engaging contact with the paper feed roller 22 by the force of the toggle spring 38. By this stopping action of the paper press roller 26, a clearance between the top end of the printing head 4 (i.e., the end facing the platen) and the platen 25 can be adjusted to a predetermined size by a one-touch operation. While the chit 41 is set in the above-mentioned manner, the switch 37 detects the position of the lever 2 to put off the printing driving circuit, and therefore, an erroneous operation can effectively be prevented. The printed chit 41 is fed upwardly by the upper paper feed roller 22.

Incidentally, if the feed speed of the upper paper feed roller 22 is made slightly larger than that of the paper feed roller 23 in printing the printing paper 20, then even when the recording paper 20 becomes slackened between the paper feed rollers 22 and 23, an upward tension is given to the recording paper 20 and the slack can be eliminated. Accordingly, by this arrangement, the recording paper 20 can be set on the platen 25 horizontally and catching of a dot needle can be prevented.

In the foregoing embodiment, the levers 2 and 3 are moved by a manual operation. In the present invention, however, there may be adopted a modification in which the levers 2 and 3 are moved by an electrical driving system using solenoids or the like. In this modification, the top ends of the levers 2 and 3 are not protruded from a cabinet and an operation switch button or the like is attached. It is preferred that a display device be disposed to indicate whether the levers 2 and 3 are located at positions capable of receiving a chit 41 or the like or they are in the paper-pressing state.

What is claimed as new and desired to be secured by Letters Patent of the United States is:

1. A printer comprising a platen and a carrier driving member, which are disposed between confronting frames, a printing head secured to a carrier which is moved reciprocatively along the platen by the carrier driving member, at least one paper-pressing roller for pressing a recording paper inserted between the printing head and the platen, said recording paper being pressed between said paper-pressing roller and a second roller, a pair of substantially linear levers pivotably mounted on said frames around central shafts thereof, said levers being elongated along the direction of advance of the recording paper and being rotatably urged in the paper-pressing direction, a first guide shaft for holding said carrier and a second shaft for holding said paper-pressing roller, said first and second shafts being attached in parallel between said two levers, whereby a variation in the spacing between said paper-pressing roller and said second roller, due to a variation in the thickness of said recording paper, pivots said levers about said central shafts, so as to automatically adjust the position of said printing head.

2. A printer as set forth in claim 1, wherein the guide shaft for holding the carrier and the shaft for holding the paper pressing roller are disposed in close proximity to each other.

3. A printer as set forth in claim 1, wherein the top end of the printing head and the paper pressing roller are aligned along the direction of advance of the recording paper.

4. A printer as set forth in claim 1, wherein said second roller comprises a paper feed roller.

5. A printer as set forth in claim 1, wherein the printing head and the paper pressing roller are arranged in such a vertical relationship that the printing head is located below the paper pressing roller.

6. A printer as set forth in claim 1, wherein paper feed rollers are disposed above and below the platen to feed the recording paper upwardly, and the paper feed speed of the upper paper feed roller is slightly higher than the paper feed speed of the lower paper feed roller.

7. A printer as set forth in claim 1, wherein the levers are urged by a toggle spring in such a manner that the urging direction is changed between the paper pressing direction and the opposite paper inserting direction with a certain position being as the boundary.

8. A printer as set forth in claim 1, wherein a detecting member for detecting the positions of the levers is disposed so that when the levers are in the paper inserting state, a printing driving circuit is shut off.

* * * * *